US009834399B1

(12) United States Patent
Hashimoto

(10) Patent No.: US 9,834,399 B1
(45) Date of Patent: Dec. 5, 2017

(54) SHEET PROCESSING SYSTEM AND CONTROL METHOD

(71) Applicants: KABUSHIKI KAISHA TOSHIBA, Tokyo (JP); TOSHIBA TEC KABUSHIKI KAISHA, Tokyo (JP)

(72) Inventor: Yoshihisa Hashimoto, Gotemba Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/408,548

(22) Filed: Jan. 18, 2017

(51) Int. Cl.

| | |
|---|---|
| ***B65H 31/20*** | (2006.01) |
| ***B65H 31/34*** | (2006.01) |
| ***B65H 9/00*** | (2006.01) |
| ***B65H 35/00*** | (2006.01) |
| ***B65H 7/20*** | (2006.01) |
| ***B65H 7/14*** | (2006.01) |
| ***B65H 7/08*** | (2006.01) |
| ***B65H 7/02*** | (2006.01) |
| ***B65H 9/10*** | (2006.01) |

(52) U.S. Cl.
CPC ..... *B65H 31/34* (2013.01); *B65H 7/02* (2013.01); *B65H 7/08* (2013.01); *B65H 7/14* (2013.01); *B65H 7/20* (2013.01); *B65H 9/002* (2013.01); *B65H 9/101* (2013.01); *B65H 31/20* (2013.01); *B65H 35/0006* (2013.01); *B65H 2301/5152* (2013.01); *B65H 2511/12* (2013.01); *B65H 2511/214* (2013.01); *B65H 2511/242* (2013.01); *B65H 2801/06* (2013.01)

(58) Field of Classification Search
CPC ..... B65H 9/00; B65H 9/002; B65H 9/10; B65H 9/101; B65H 9/20; B65H 31/20; B65H 31/34
See application file for complete search history.

(56) References Cited

U.S. PATENT DOCUMENTS

| | | | | |
|---|---|---|---|---|
| 7,650,823 | B2 | 1/2010 | Iguchi | |
| 8,042,796 | B2 * | 10/2011 | Iguchi | B65H 35/00 270/58.02 |
| 2009/0243201 | A1 * | 10/2009 | Isogai | B65H 7/08 271/227 |
| 2010/0061783 | A1 * | 3/2010 | Kawasaki | B65H 9/002 399/381 |
| 2015/0183605 | A1 * | 7/2015 | Kato | B65H 9/002 271/227 |
| 2016/0282782 | A1 * | 9/2016 | Yamakawa | G03G 15/6529 |

* cited by examiner

*Primary Examiner* — Prasad V Gokhale
(74) *Attorney, Agent, or Firm* — Patterson & Sheridan, LLP

(57) ABSTRACT

A sheet processing system according to an embodiment includes a tray that supports a sheet on opposite sides of the sheet orthogonal to a conveyance direction of the sheet. The tray includes a first adjustable support and second adjustable support positioned opposite the first adjustable support in the direction orthogonal to the conveyance direction of the sheet. A skew sensor detects a skew angle of the sheet conveyed to the tray. A corner sensor detects positions of each corner on a front end in the downstream direction of the sheet conveyed to the tray. A controller controls movement of the first and second adjustable supports based on the detected skew angle and the detected positions of each corner on the front end of the sheet conveyed to the tray so that the sheet is conveyed to the tray without jamming.

20 Claims, 10 Drawing Sheets

SHEET PROCESSING SYSTEM AND CONTROL METHOD

FIELD

Embodiments described herein relate generally to a sheet processing system and a control method.

BACKGROUND

A sheet processing system may be provided with a post-processing apparatus which carries out a post processing on a sheet on which an image is formed. The post-processing apparatus carries out, for example, a processing for punching a hole on a sheet, or a processing for binding sheets with a stapler. In the post processing apparatus, there is a device, like the stapler, which carries out a processing on a plurality of sheets. In order to carry out such a post processing on the plurality of sheets, a standby tray temporarily keeps the plurality of the sheets at a standby position.

A size (for example, A size, B size and the like) of the waiting sheet is provided to the standby tray. The standby tray adjusts positions of supports for supporting the sheet from sides based on the size provided.

In this manner, the standby tray adjusts the positions of the supports according to the size. However, when the sheet is conveyed the standby tray, a skew may be generated. Further, there are times when an incorrect size is detected, and the incorrect size is provided to the standby tray.

In a case in which the skew is generated or the size is incorrectly detected, a paper jam may occur.

DETAILED DESCRIPTION

A sheet processing system according to an embodiment includes a tray that supports a sheet on opposite sides of the sheet orthogonal to a conveyance direction of the sheet. The tray includes a first adjustable support and second adjustable support positioned opposite the first adjustable support in the direction orthogonal to the conveyance direction of the sheet. The first and second adjustable supports are independently movable in the direction orthogonal to the conveyance direction. A skew sensor detects a skew angle of the sheet conveyed to the tray. A corner sensor detects positions of each corner on a front end in the downstream direction of the sheet conveyed to the tray. A controller controls movement of the first and second adjustable supports based on the detected skew angle and the detected positions of each corner on the front end of the sheet conveyed to the tray so that the sheet is conveyed to the tray without jamming.

Figure 1:
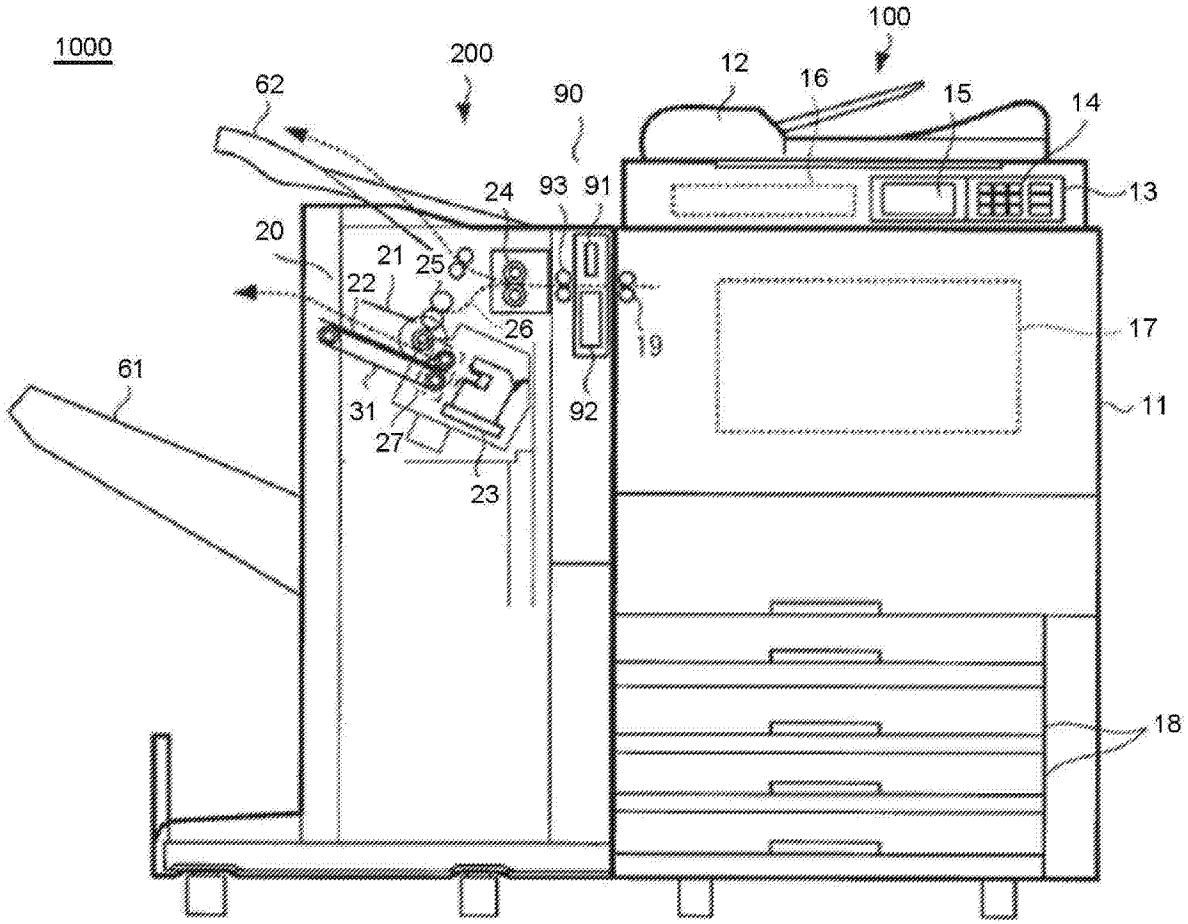
FIG. 1 is a diagram illustrating a schematic configuration of an example sheet processing system according to an embodiment.

FIG. 1 is a diagram illustrating a schematic configuration of an example sheet processing system 1000 according to the present embodiment. The sheet processing system 1000 includes an image forming apparatus 100 and a sheet processing apparatus 200.

The image forming apparatus 100 is an MFP (Multi-Function Peripheral), a printer or a copier. The sheet processing apparatus 200 is adjacent to the image forming apparatus 100.

A sheet on which an image is formed by the image forming apparatus 100 is conveyed to the sheet processing apparatus 200. The sheet processing apparatus 200 carries out a post processing on the sheet supplied from the image forming apparatus 100. The post processing is, for example, a sorting processing and/or a stapling processing. As necessary, the post processing may include a processing for folding a sheet in two after carrying out saddle stitching on the sheet and discharging the folded sheet.

In the sheet processing system 1000 shown in FIG. 1, a punch mechanism 90 is positioned between the image forming apparatus 100 and the sheet processing apparatus 200. The punch mechanism 90 is a type of sheet processing apparatus.

In FIG. 1, a document table (not shown) is positioned at the upper part of a main body 11 of the image forming apparatus 100, and an ADF (Auto Document Feeder) 12 is positioned on the document table in an openable manner. Furthermore, an operation panel 13 is positioned at the upper part of the main body 11. The operation panel 13 includes an operation unit 14 including various keys and a touch-panel type display unit 15.

The main body 11 includes a scanner unit 16 and a printer unit 17. Furthermore, a plurality of cassettes 18 in which sheets with various sizes are housed is positioned at the lower part of the main body 11. The scanner unit 16 reads a document sent from the ADF 12 or a document placed on the document table.

The printer unit 17 includes a photoconductive drum and a laser. The printer unit 17 scans the surface of the photoconductive drum through a laser beam from the laser to expose the surface, and creates an electrostatic latent image on the photoconductive drum.

A charger, a developing device, a transfer device and the like (not shown) are positioned in the vicinity of the photoconductive drum. The electrostatic latent image of the photoconductive drum is developed by the developing device, and a toner image is formed on the photoconductive drum. The toner image is transferred onto the sheet by the transfer device, and further fixed on the sheet by a fixing device. The configuration of the printer unit 17 is not limited to the foregoing example, and the printer unit 17 may be implemented as other various forms.

The sheet processing apparatus 200 includes a staple mechanism 20 for carrying out the stapling processing on a sheet bundle. Further, a saddle unit for carrying out the saddle stitching and folding processing of the sheet is also included in the sheet processing apparatus 200.

The punch mechanism 90 is positioned between the main body 11 and the sheet processing apparatus 200. The punch mechanism 90 includes a punch mechanism 91 and a dust box 92. Further, the punch mechanism 90 includes a corner sensor and a skew sensor which are described later. Rollers 19 and 93 for sheet conveyance are positioned on a path from the main body 11 to the sheet processing apparatus 200.

The sheet discharged from the main body 11 is conveyed to the sheet processing apparatus 200 via the rollers 19 and 93. Punching (perforation) by the punch mechanism 91 is executed when a user operates the operation panel 13 and sets a mode to a punch mode.

The sheet processing apparatus 200 includes a standby tray 21, a processing tray 22, and a stapler 23. Further, the sheet processing apparatus 200 includes a discharge tray 61 and a fixing tray 62. The discharge tray 61 may be configured to ascend and descend. A sheet P discharged by the discharge roller 19 of the image forming apparatus 100 is received by an inlet roller 24 positioned in the vicinity of a carry-in port of the sheet processing apparatus 200. The inlet roller 24 is composed of an upper roller and a lower roller.

A sheet feed roller 25 is positioned at the downstream side of the inlet roller 24. The sheet P received by the inlet roller 24 is sent to the standby tray 21 via the sheet feed roller 25. The sheet feed roller 25 is composed of an upper roller and a lower roller. A conveyance path 26 for guiding the sheet P to the sheet feed roller 25 is positioned between the inlet roller 24 and the standby tray 21. The processing tray 22 for stacking the sheet P which falls from the standby tray 21 is arranged below the standby tray 21.

A plurality of sheets may be stacked on the standby tray 21 in order to carry out the post processing on the sheets. Further, the standby tray 21 is an openable structure, and is opened if a number of the sheets P are stacked thereon, the number being input in the operation unit 14 in connection with the instruction for the post processing. The sheet P falls to the processing tray 22 through its own weight or an operation of a fall assistance member which pushes the sheet P through the opened structure. The processing tray 22 for carrying out the post processing aligns and supports the sheets P while the sheets P are stapled by the stapler 23. The stapler is an example of a post processing unit.

The sheet falling to the processing tray 22 is guided to the stapler 23 through a roller 27. The stapler 23 then carries out the stapling processing. The roller 27 is composed of an upper roller and a lower roller. With respect to the stapling processing on the sheets, the plurality of the sheets P falling from the standby tray 21 to the processing tray 22 is stapled after being aligned in the longitudinal direction parallel to the conveyance direction and aligned in the lateral direction orthogonal to the conveyance direction. A conveyance belt 31 is driven rotationally, and cyclically moves rotationally between the stapler 23 and the discharge port along the discharge direction of the sheet.

Figure 2:
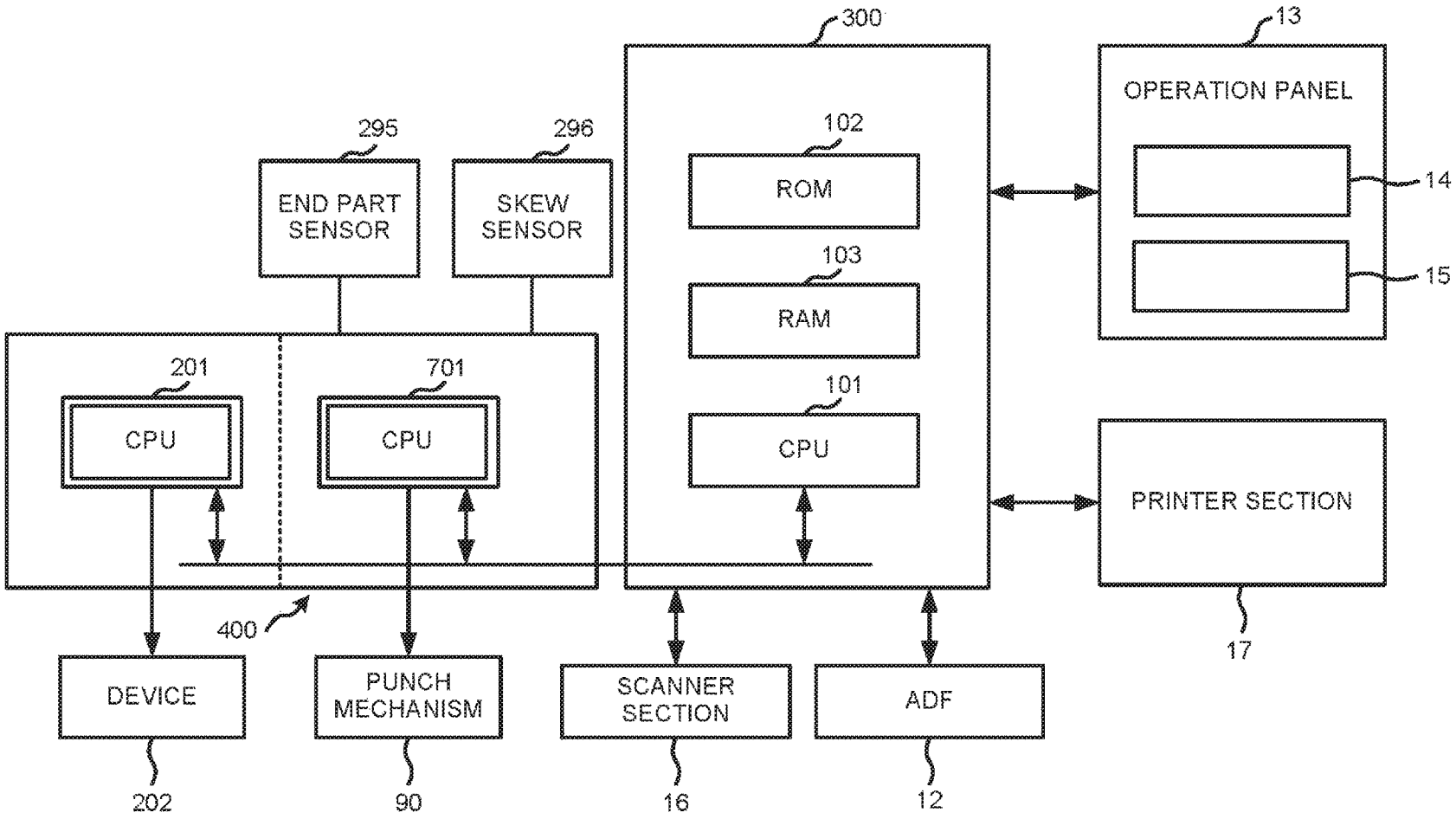
FIG. 2 is a block diagram illustrating control systems of an sheet forming apparatus and a sheet processing apparatus.

FIG. 2 is a block diagram illustrating control systems of the image forming apparatus 100 and the sheet processing apparatus 200.

In FIG. 2, a main control unit 300 includes a CPU (Central Processing Unit) 101, a ROM (Read Only Memory) 102 and a RAM (Random Access Memory) 103. The main control unit 300 controls the image forming apparatus 100 according to a control program stored in the ROM 102. The main control unit 300 controls operations of the ADF 12, the scanner unit 16 and the printer unit 17 in response to operations from the operation panel 13. The RAM 103 temporarily stores control data or is used in an arithmetic job at the time of the control.

The operation panel 13 includes the operation unit 14, which includes the plurality of the keys, and the display unit, 15 which also serves as a touch panel. The operation panel 13 can receive various instructions for image formation. For example, an instruction of the copy number and an operation of manual stapling may be input by using the operation unit 14. Further, a sheet size, a sheet type, an instruction for the stapling and an instruction for the sheet folding are input by operating the touch panel of the display unit 15.

Further, the sheet processing apparatus 200 includes a control unit 400 which controls the sheet processing apparatus 200. The control unit 400 controls the operations of the staple mechanism 20 and the punch mechanism 90 of the sheet processing apparatus 200. Further, the control unit 400 controls each device in the sheet processing apparatus 200.

The control unit 400 is connected to an corner sensor 295 and a skew sensor 296. The corner sensor 295 detects positions of both corners of a front end at the downstream side of the sheet P. The skew sensor 296 detects a skew angle of the sheet P.

The control unit 400 includes a first control unit 201 including a CPU and a second control unit 701 including a CPU. The CPUs of the first and second control units 201 and 701 are connected with the CPU 101 of the main control unit 300 via a bus line and carry out transmission of information between the main control unit 300 and the control unit 400, and the image forming apparatus 100 and the sheet processing apparatus 200 cooperate to operate. Alternatively, the first control unit 201 and second control unit 701 may be implemented in a single CPU corresponding to control unit 400 programmed to execute the various functions.

The first control unit 201 controls each device 202 of the staple mechanism 20, and the second control unit 701 controls the punch mechanism 90. Controlling the staple mechanism 20 includes performing of the stapling by the stapler 23, conveying the sheet P to the stapler 23, and discharging the stapled sheet.

Controlling the punch mechanism 90 includes ensuring that the punching is carried out at a proper position on the basis of the skew angle detected by the skew sensor 296 and the positions detected by the corner sensor 295.

The device 202 includes the standby tray 21, the processing tray 22, the stapler 23 and the conveyance belt 31.

Figure 3:
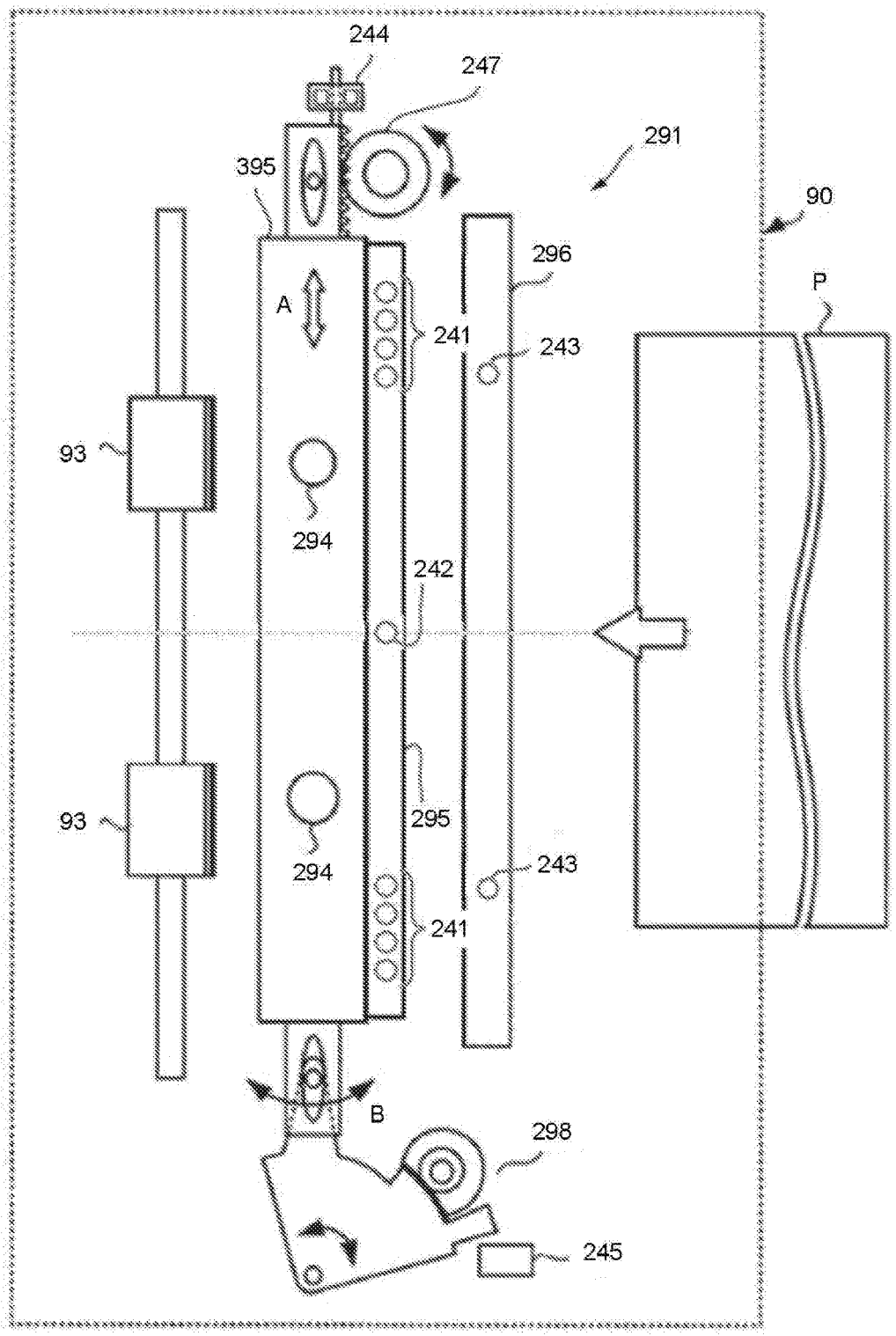
FIG. 3 is a plan view schematically illustrating a configuration of a punch mechanism.

FIG. 3 is a plan view schematically illustrating the configuration of the punch mechanism 90. The punch mechanism 90 is positioned between the image forming apparatus 100 and the staple mechanism 20, and includes the punch mechanism 91 and the dust box 92 (refer to FIG. 2). The punch mechanism 90 includes the roller 93 for sheet conveyance.

The punch mechanism 291 includes a hole punching unit 395 with a punching blade 294 which carries out the punching on the sheet P. When the punching blade 294 is descended, a punched hole is made in the sheet P. Further, punch scrap generated by the punching drops into the dust box 92. The punching blade 294 is driven through rotation of a punch motor (not shown). The punching by the punch mechanism 291 is executed when the user operates the operation panel 13 and sets a mode to the punch mode.

The hole punching unit 395 may move in an arrow A direction (lateral direction) orthogonal to the conveyance direction of the sheet P. One end (lower end in the figure) of the hole punching unit 395 may rotate through a maximum predetermined angle in an arrow B direction.

The punch mechanism 291 includes a moving mechanism 297 for moving the hole punching unit 395 in the lateral direction (arrow A direction), and an attitude control unit 298 for rotating the hole punching unit 395 in the arrow B direction to control the attitude.

The corner sensor 295 includes sensors 241 and 242. The sensors 241 detect the positions of both sides of the front end of the sheet P. The sensor 242 detects the front end and the rear end of the sheet P. The sensors 241 each include a plurality of sensors. The positions of both sides can be detected through the positions of the sensors which detects the sheet P among the plurality of the sensors. For example, the sheet P may be detected by two sensors of the inside of the sensors 241 shown in FIG. 3. In this case, the positions of the sensors outside of the detecting sensors which detect the sheet P are set as the positions of the sides of the sheet P. Thus, in a case in which the sheet P is rotated relative to the corner sensor 295 due to the skew, it is necessary to correct the detected position.

The skew sensor 296 includes sensors 243. The skew sensor 296 detects the skew angle with the two sensors 243.

The hole punching unit 395 moves in the arrow A direction in response to the positions of both sides of the front end at the downstream side of the sheet P detected by the corner sensor 295. The hole punching unit 395 is rotated and inclined in the arrow B direction to correspond to the skew angle of the skewed sheet P detected by the skew sensor 296.

The punch mechanism 90 includes a sensor 244 for detecting a home position of the hole punching unit 395 in the lateral direction (A direction). The punch mechanism 90 includes a sensor 245 for detecting a home position of the hole punching unit 395 in the longitudinal direction (B direction).

Figure 4:
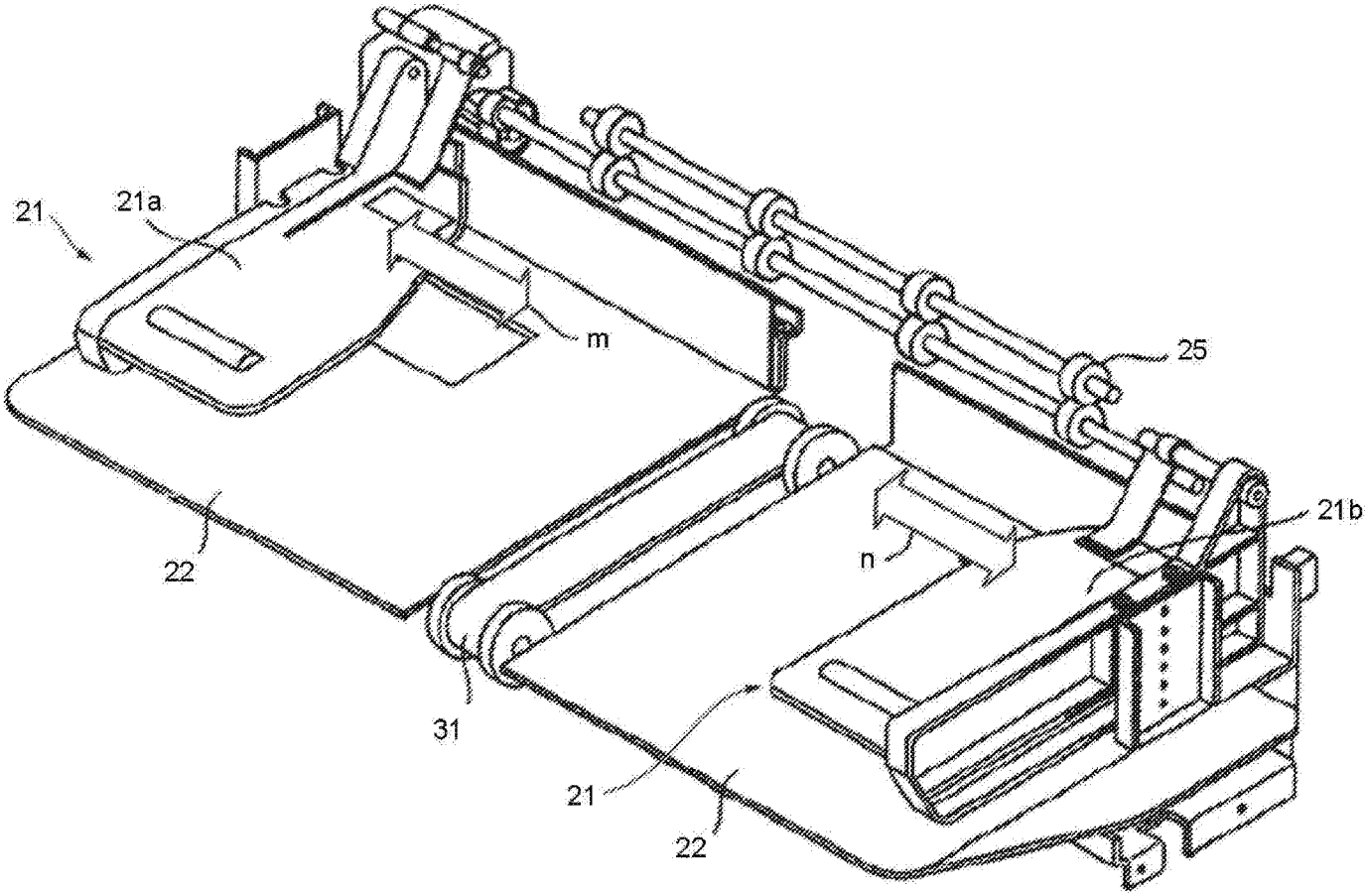
FIG. 4 is a diagram illustrating a perspective view of a standby tray and a processing tray.
Figure 5:
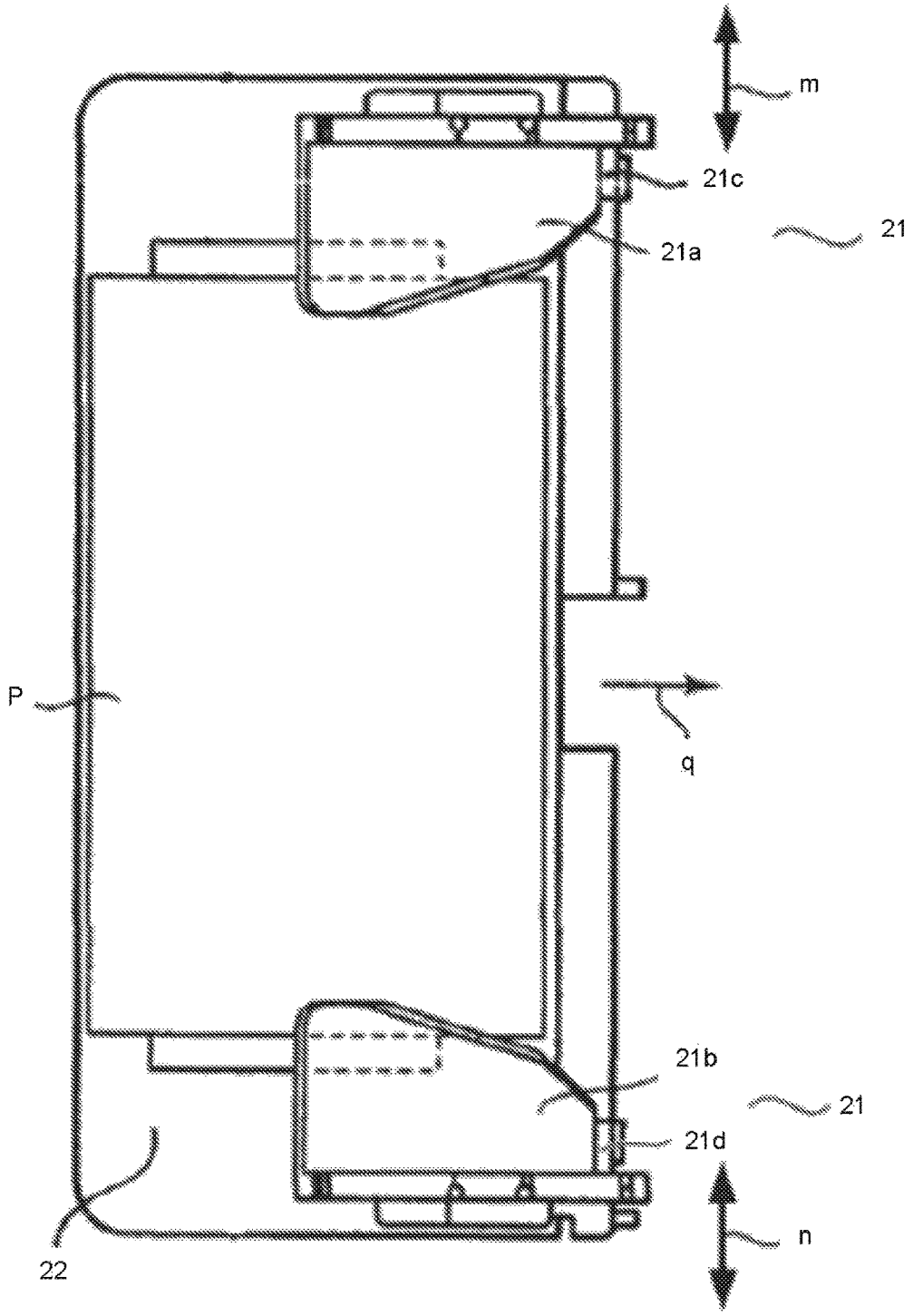
FIG. 5 is a diagram illustrating a plan view of the standby tray and the processing tray.

FIG. 4 and FIG. 5 are diagrams illustrating the standby tray 21 and the processing tray 22. As shown in FIG. 4, the standby tray 21 includes a pair of tray members 21*a* and 21*b*. The tray members 21*a* and 21*b* support both sides of the sheet P. As shown in FIG. 5, stoppers 21*c* and 21*d* for regulating the rear end of the sheet P are arranged in the tray members 21*a* and 21*b*.

The tray member 21*a* movably slides in an arrow m direction. The tray member 21*b* movably slides in an n direction. The slide amount of the tray members 21*a* and 21*b* is controlled by the first control unit 201.

In a case in which an interval between the tray members 21*a* and 21*b* is smaller than a width of the conveyed sheet P, paper jam is generated.

Therefore, the skew angle detected by the skew sensor 296 and the positions detected by the corner sensor 295 are provided from the second control unit 701 to the first control unit 201.

Then, the first control unit 201 adjusts the positions of the tray members 21*a* and 21*b* on the basis of the skew angle detected by the skew sensor 296 and the positions detected by the corner sensor 295.

Figure 6:
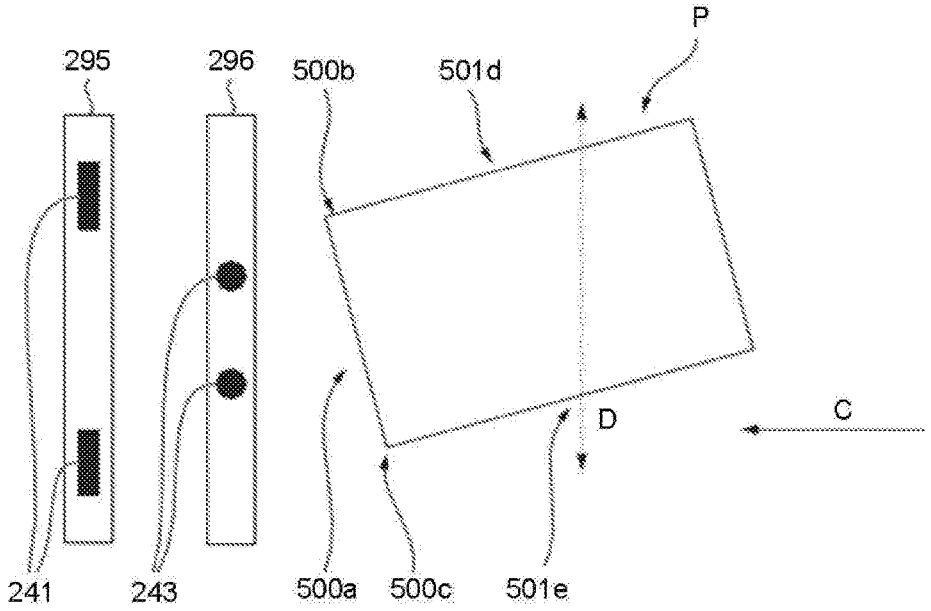
FIGS. 6-9 illustrate detection of a skew angle of a sheet P.

FIG. 6 to FIG. 9 are diagrams illustrating detection of the skew angle of the sheet P. In FIG. 6, the corner sensor 295, the skew sensor 296 and the sheet P are shown.

In FIG. 6 to FIG. 9, the sheet P is conveyed in an arrow C direction. An arrow D indicates a direction orthogonal to the conveyance direction of the sheet P. If the sheet P is conveyed to the standby tray 21, the support member 21*a* supports a side 501*d* of the sheet P, and the support member 21*b* supports a side 501*e* of the sheet P.

Figure 7:
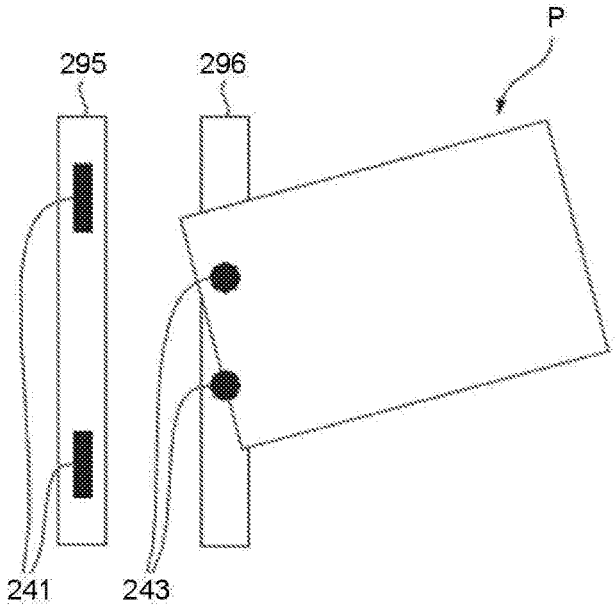
Figure 8:
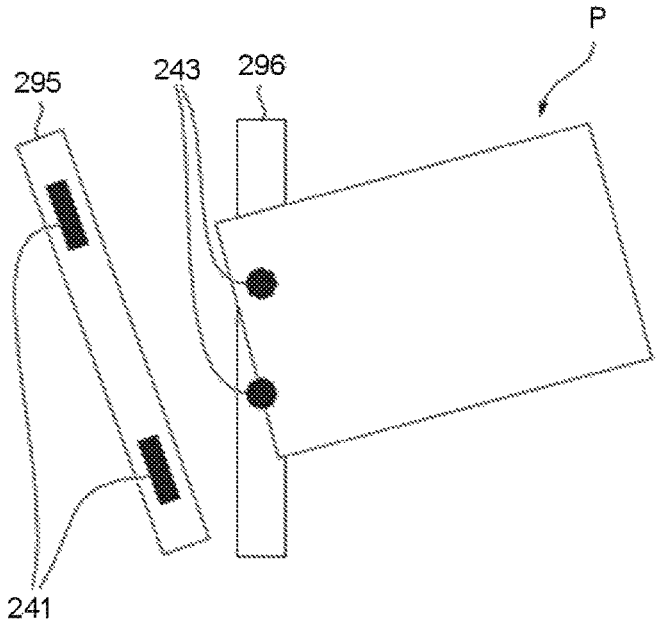
Figure 9:
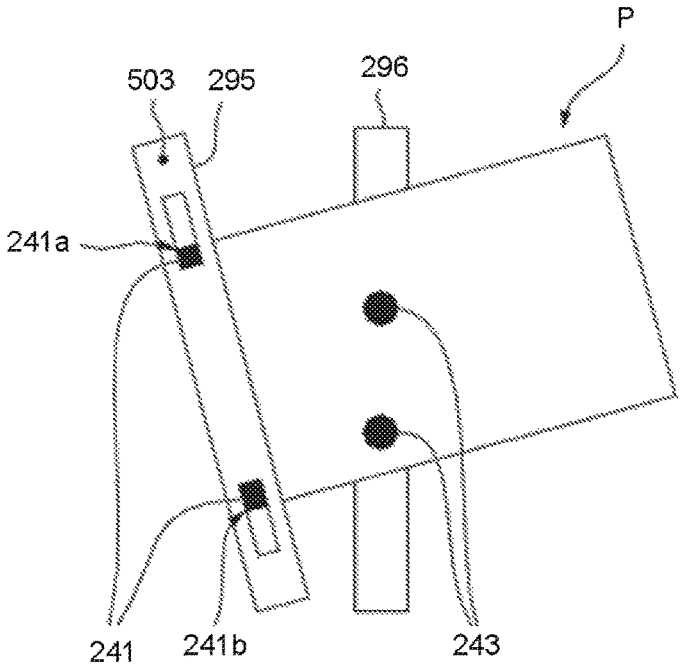

The corner sensor 295 detects both corners 500*b* and 500*c* of a front end 500*a* at the downstream side of the sheet P. In FIG. 7 to FIG. 9 described below, signs indicating the front end 500*a*, both front corners 500*b* and 500*c*, and the sides 501*d* and 501*e* are omitted.

FIG. 7 is a diagram illustrating a state in which the skew angle is detected by the skew sensor 296. The skew sensor 296 starts count of a pulse when the sheet P is detected by one of the two sensors 243. The pulse refers to a pulse output from an encoder of a stepping motor for conveying the sheet P.

The skew sensor 296 stops the count of the pulse when the sheet P is detected by the other one of the two sensors 243 after the count of the pulse is started. The pulse is in proportion to a conveyance distance of the sheet P, and thus the conveyance distance is calculated according to the counted pulse. The skew sensor 296 calculates the skew angle according to the calculated conveyance distance. A calculation method of the skew angle is described later.

FIG. 8 is a diagram illustrating the corner sensor 295 which is rotated with the skew angle detected. As described in connection with FIG. 3, in a case in which the sheet P is skewed, the hole punching unit 395 is also rotated matching the skew angle.

FIG. 9 is a diagram illustrating a state in which both corners 500*b* and 500*c* are detected by the corner sensor 29. In FIG. 9, in the corner sensor 295, areas where the sheet P is detected are indicated in black, and areas where the sheet P is not detected are indicated in white. Thus, positions 241 and 241*b* are detected positions of both corners. The corner sensor 295 is rotated matching the skew angle around a rotational axis 503. Thus, it is necessary to correct the positions of the detected corners. This correction method is described later. It is possible that a distance between the rotational axis 503 and the plurality of the sensors of the corner sensor 295 is calculated by the corner sensor 295. In other words, it is possible to calculate distances between the rotational axis 503.

Figure 10:
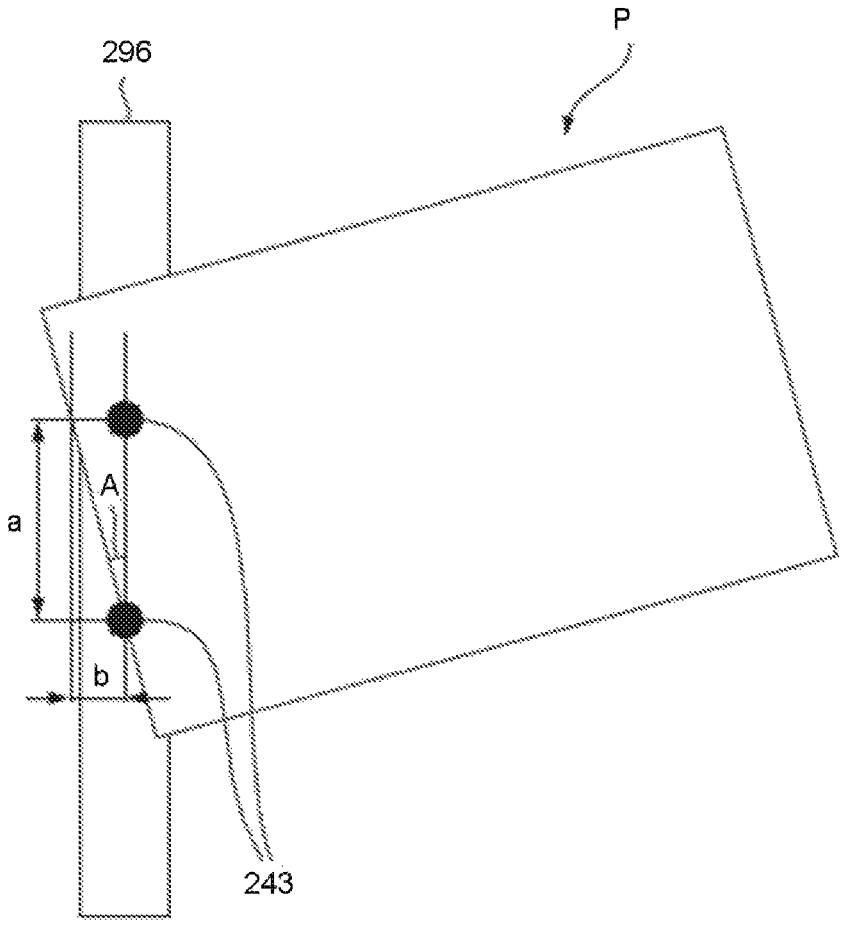
FIG. 10 is a diagram illustrating a method of calculating a skew angle by a skew sensor.

FIG. 10 is a diagram illustrating the calculation method of the skew angle using the skew sensor 296. As stated above, the conveyance distance is calculated according to the counted pulse. Thus, a distance b shown in FIG. 10 is calculated according to the pulse. Further, a distance a shown in FIG. 10 is a distance between the two sensors 243, and thus is already known. Therefore, the skew angle A is arctan (b/a).

Figure 11:
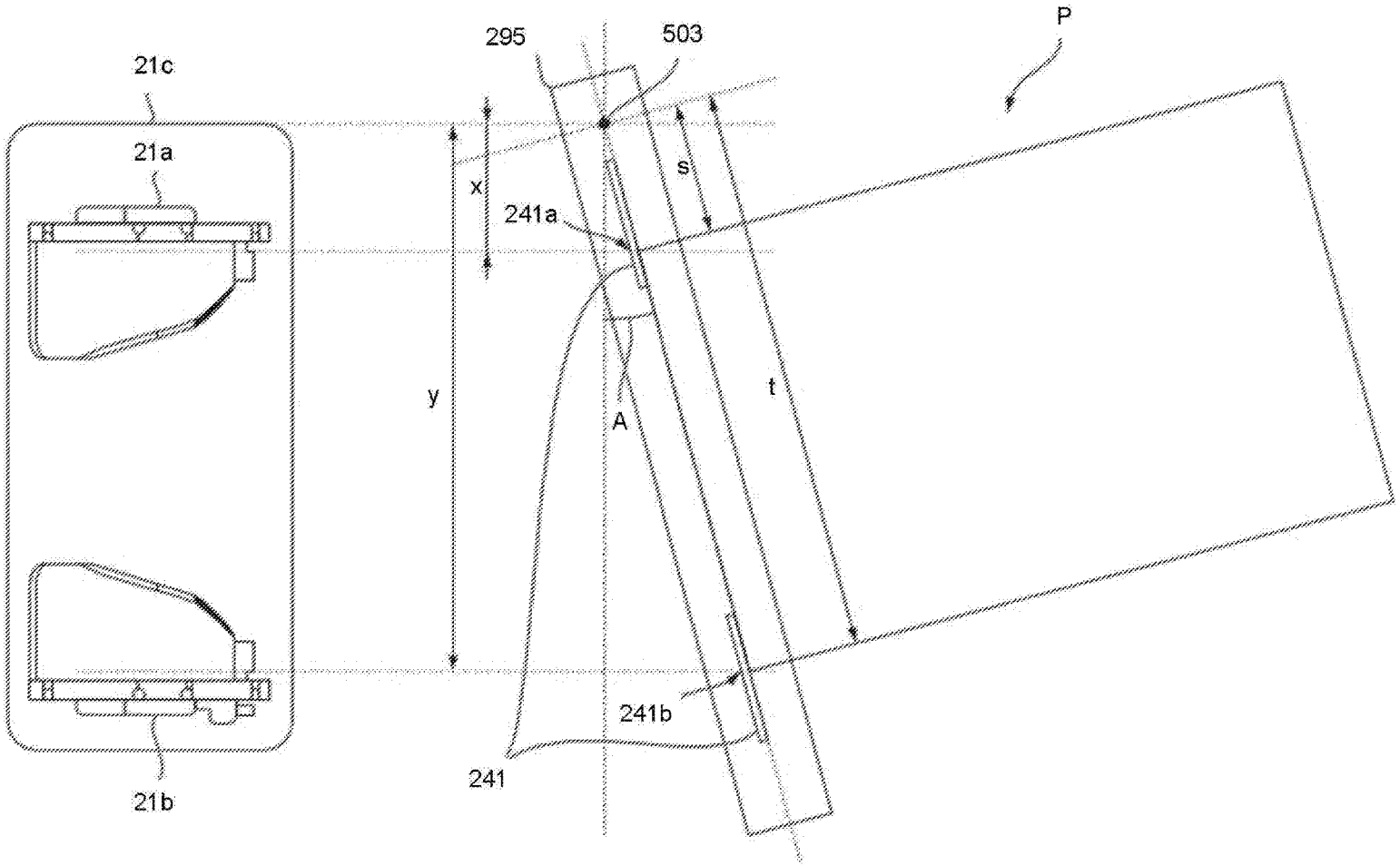
FIG. 11 is a diagram illustrating a method of correcting a detected skew.

FIG. 11 is a diagram illustrating the method of correcting the positions detected by the corner sensor 295. In FIG. 11, the corner sensor 295 is rotated around the rotational axis 503 at only the skew angle A detected by the skew sensor 296. Then, the corners 241*a* and 241*b* are set as the positions of both corners detected by the corner sensor 295.

A distance between the position 241*a* and the rotational axis 503 is set to s, and a distance between the position 241*b* and the rotational axis 503 is set to t. Further, a distance from the rotational axis 503 for correcting the distance s is set to x, and a distance from the rotational axis 503 for correcting the distance t is set to y.

At this time, the corrected distance x becomes s×cos (A) and the corrected distance y becomes t×cos (A) according to the cosine to the skew angle A. However, if the support members 21*a* and 21*b* slide to the positions of these s×cos (A) and t×cos (A), there is no margin between the support members 21*a* and 21*b* and the sheet P. Therefore, in order to hold some margin, the first control unit 201 adjusts the position X of the support member 21*a* to $x$-$a$ and the position Y of the support member 21*b* to $y+\beta$ by using constants $\alpha$ and $\beta$($\alpha>0$ and $\beta>0$).

In this manner, it is possible for the standby tray 21 to hold both ends of the sheet by adjusting the positions of the support members 21*a* and 21*b*, and thus the generation of the paper jam can be suppressed.

Further, in a case in which the skew is generated, even if it is possible for the standby tray 21 to hold both ends of the sheet, as the sheet P advances slantingly, there is a high possibility that the paper jam is generated. Thus, the constants α and β may be changed depending on the skew angle. For example, the following formula may be obtained by using constants L and M: α=L×tan (A)+M, and β=L×tan (A)+M. The constant L is a coefficient for sliding the tray members 21*a* and 21*b* in the directions of the outside of the arrows m and n according to the skew angle. More specifically, the constant L is a coefficient for expanding the interval between the tray members 21*a* and 21*b* as the skew angle becomes large. The constant M is a margin maintained between the corners of the sheet P and the support member. The constants L and M are changed according to the structure of the standby tray 21, the conveyance speed of the sheet, the thickness of the sheet and the like. Thus, the first control unit 201 may hold the suitable constants L and M obtained through various experiments in advance.

Through the above, the first control unit 201 adjusts the positions at which the support members 21*a* and 21*b* support the sheet through the following processing if receiving the skew angle A and the positions s and t of both ends from the second control unit 701. In other words, the first control unit 201 calculates the position X of the support member 21*a* and the position Y of the support member 21*b* by using the following formula.

$$X=s\times\cos(A)-L\times\tan(A)-M \quad \text{(formula 1)}$$

$$Y=t\times\cos(A)+L\times\tan(A)+M \quad \text{(formula 2)}$$

The first control unit 201 slides the support member 21*a* to the calculated position X and slides the support member 21*b* to the position Y. Formulas 1 and 2 are also applied to a case in which the skew is not generated, that is, a case in which A is 0. In fact, if "A=0" is substituted to the foregoing formula, the following formulas are obtained: X=s−M, and Y=t+M, and suitable values are calculated.

Thus, the first control unit 201 may substitute the skew angle A and the positions s and t of both ends to the foregoing formula without determining whether or not the sheet is skewed.

Figure 12:
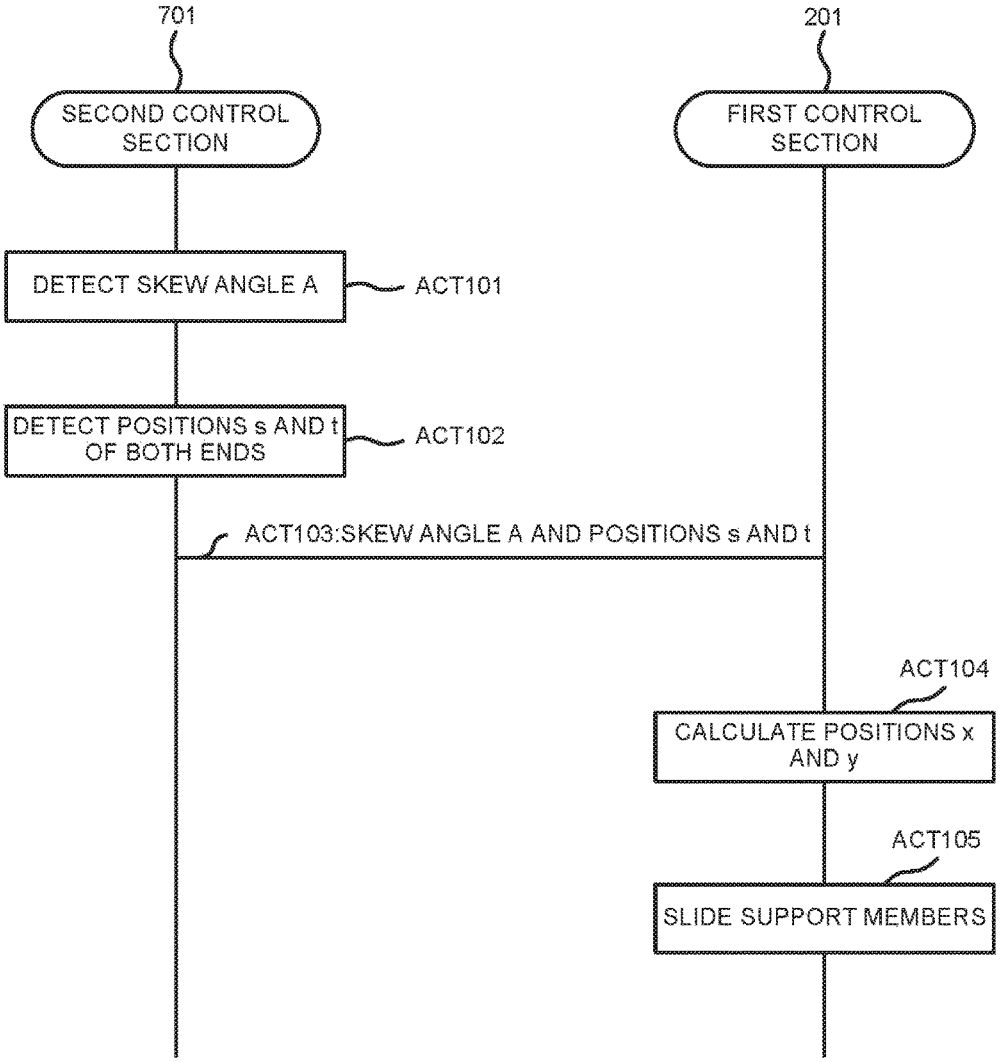
FIG. 12 is a diagram illustrating an example of a sequence of operations by a control unit.

FIG. 12 is a diagram illustrating an example sequence of operations by the first and second control units 201 and 701, of the control unit 400. The second control unit 701 detects the skew angle A with the skew sensor 296 (ACT 101). The second control unit 701 detects the positions s and t of both corners with the corner sensor 295 (ACT 102). The second control unit 701 provides the skew angle A and the positions s and t of both ends to the first control unit 201 (ACT 103).

The first control unit 201 uses the provided skew angle A and the provided positions s and t of both ends to the formula 1 to calculate the positions X and Y (ACT 104). The first control unit 201 slides the support member 21*a* to the calculated position X, and slides the support member 21*b* to the position Y (ACT 105).

Further, in the formula 1, "L×tan (A)" is also used to calculate either of X and Y; however, the present invention is not limited to this.

For example, in FIG. 11, the sheet P is shifted towards the left side when viewed from the standby tray 21. On the other hand, the sheet P is not shifted towards the right side. Thus, the slide amount of the tray member may be calculated by using "L×tan (A)" is calculated only in a case in which the position at which the tray member corresponding to the side to which the sheet P is shifted supports the sheet P. For example, in the example in FIG. 11, the slide amount of the tray member 21*a* towards the left side direction (direction of the outside) is calculated by using "L×tan (A)".

According to the present embodiment described above, the occurrence of the paper jam can be suppressed by adjusting the positions at which the tray members support the sheet on the basis of the skew angle and the positions of the detected corners.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet processing system, comprising:

a tray configured to support a sheet on opposite sides of the sheet orthogonal to a conveyance direction of the sheet, the tray including a first adjustable support and second adjustable support positioned opposite the first adjustable support in the direction orthogonal to the conveyance direction of the sheet, the first and second adjustable supports being independently movable in the direction orthogonal to the conveyance direction;

a skew sensor configured to detect a skew angle of the sheet conveyed to the tray;

a corner sensor configured to detect positions of each corner on a front end in the downstream direction of the sheet conveyed to the tray; and a controller configured to control movement of the first and second adjustable supports based on the detected skew angle and the detected positions of each corner on the front end of the sheet conveyed to the tray so that the sheet is conveyed to the tray without jamming.

2. The sheet processing system according to claim 1, wherein the corner sensor is configured to rotate through a predetermined angle in a plane of the sheet.

3. The sheet processing system according to claim 2, wherein the controller is further configured to control a rotation of the corner sensor based on the detected skew angle so that the corner sensor is substantially parallel to the front end of the sheet conveyed to the tray when the corner sensor detects the positions of each corner on the front end of the sheet conveyed to the tray.

4. The sheet processing system according to claim 3, wherein:

the controller moves the first adjustable support to a position X in the direction orthogonal to the conveyance direction of the sheet given by $$X=s\times\cos(A)-L\times\tan(A)-M, \text{ and}$$

the controller moves the second adjustable support to a position Y in the direction orthogonal to the conveyance direction of the sheet given by $$Y=t\times\cos(A)-L\times\tan(A)+M,$$

where s is the detected position of a first corner of the front end of the sheet, t is the detected position of a second corner of the front end of the sheet, A is the detected skew angle, and L and M are predetermined constants.

5. The sheet processing system according to claim 4, wherein:

L is a predetermined constant calculated in advance for expanding an interval between the first and second adjustable supports as A becomes large, and M is a predetermined constant calculated in advance for maintaining a margin between the corners of the front end of the sheet and the corresponding adjustable supports.

6. The sheet processing system according to claim 1, further comprising:

a punch unit configured to carry out punching on a sheet at an upstream side of the tray in the sheet conveying direction, wherein the skew sensor and the corner sensor are positioned in the punch unit.

7. The sheet processing system according to claim 1, further comprising:

a processing unit configured to perform a post processing on one or more sheets; and a processing tray configured to support the one or more sheets on which the post processing is formed, wherein:

when a number of sheets corresponding to a post processing instruction are stacked on the tray, the first and second adjustable supports are moved away from the sheets stacked on the tray in the direction orthogonal to the conveyance directions so that the sheets are moved to the processing tray in order to carry out the post processing in accordance with the post processing instruction.

8. A sheet processing method, comprising the steps of:

conveying a sheet on a conveying path towards a tray configured to support a sheet on opposite sides of the sheet orthogonal to a conveyance direction of the sheet, the tray including a first adjustable support and second adjustable support positioned opposite the first adjustable support in the direction orthogonal to the conveyance direction of the sheet, the first and second adjustable supports being independently movable;

detecting a skew angle of the sheet conveyed towards the tray;

detecting positions of each corner on a front end in the downstream direction of the sheet conveyed towards the tray; and controlling movement of the first and second adjustable supports in the direction orthogonal to the conveyance direction based on the detected skew angle and the detected positions of each corner on the front end of the sheet so that the sheet is conveyed to the tray without jamming.

9. The sheet processing method according to claim 8, wherein the positions of each corner on the front end of the sheet are detected by a corner sensor configured to rotate through a predetermined angle in a plane of the sheet.

10. The sheet processing method according to claim 9, further comprising the step of:

rotating the corner sensor based on the detected skew angle so that the corner sensor is substantially parallel to the front end of the sheet conveyed to the tray when the corner sensor detects the positions of each corner on the front end of the sheet conveyed to the tray.

11. The sheet processing method according to claim 10, wherein:

the first adjustable support is moved to a position X in the direction orthogonal to the conveyance direction of the sheet given by $$X=s\times\cos(A)-L\times\tan(A)-M, \text{ and}$$

the second adjustable support is moved to a position Y in the direction orthogonal to the conveyance direction of the sheet given by $$Y=t\times\cos(A)-L\times\tan(A)+M,$$

where s is the detected position of a first corner of the front end of the sheet, t is the detected position of a second corner of the front end of the sheet, A is the detected skew angle, and L and M are predetermined constants.

12. The sheet processing method according to claim 11, wherein:

L is a predetermined constant calculated in advance for expanding an interval between the first and second adjustable supports as A becomes large, and M is a predetermined constant calculated in advance for maintaining a margin between the corners of the front end of the sheet and the corresponding adjustable supports.

13. The sheet processing method according to claim 8, further comprising the step of:

punching the sheet at an upstream side of the tray in the sheet conveying direction with a punch unit, wherein the skew sensor and the corner sensor are positioned in the punch unit.

14. The sheet processing method according to claim 8, further comprising the steps of:

when a number of sheets corresponding to a post processing instruction are stacked on the tray, moving the first and second adjustable supports away from the sheets stacked on the tray in the direction orthogonal to the conveyance directions so that the sheets are moved to a processing tray;

supporting the sheets on the processing tray; and while the sheets are supported on the processing tray, performing a post processing in accordance with the post processing instruction on the sheets.

15. A sheet processing system for controlling a standby tray in a post processing apparatus, the system comprising:

a skew sensor configured to detect a skew angle of a sheet conveyed to a standby tray including a first adjustable support and second adjustable support positioned opposite the first adjustable support in the direction orthogonal to the conveyance direction of the sheet;

a corner sensor configured to detect positions of each corner on a front end in the downstream direction of the sheet conveyed to the standby tray; and a controller configured to control movement of the first and second adjustable supports based on the detected skew angle and the detected positions of each corner on the front end of the sheet conveyed to the standby tray so that the sheet is conveyed to the standby tray without jamming.

16. The sheet processing system according to claim 15, wherein the corner sensor is configured to rotate through a predetermined angle in a plane of the sheet.

17. The sheet processing system according to claim 16, wherein the controller is further configured to control a rotation of the corner sensor based on the detected skew angle so that the corner sensor is substantially parallel to the front end of the sheet conveyed to the tray when the corner sensor detects the positions of each corner on the front end of the sheet conveyed to the tray.

18. The sheet processing system according to claim 17, wherein:

the controller moves the first adjustable support to a position X in the direction orthogonal to the conveyance direction of the sheet given by $$X=s\times\cos(A)-L\times\tan(A)-M, \text{ and}$$

the controller moves the second adjustable support to a position Y in the direction orthogonal to the conveyance direction of the sheet given by $$Y=t\times\cos(A)-L\times\tan(A)+M,$$

where s is the detected position of a first corner of the front end of the sheet, t is the detected position of a second corner of the front end of the sheet, A is the detected skew angle, L is a predetermined constant calculated in advance for expanding an interval between the first and second adjustable supports as A becomes large, and M is a predetermined constant calculated in advance for maintaining a margin between the corners of the front end of the sheet and the corresponding adjustable supports.

19. The sheet processing system according to claim 15, further comprising:

a punch unit configured to carry out punching on a sheet at an upstream side of the tray in the sheet conveying direct ion, wherein the skew sensor and the corner sensor are positioned in the punch unit.

20. The sheet processing system according to claim 15, further comprising:

a processing unit configured to perform a post processing on one or more sheets; and a processing tray configured to support the one or more sheets on which the post processing is formed, wherein:

when a number of sheets corresponding to a post processing instruction are stacked on the tray, the first and second adjustable supports are moved away from the sheets stacked on the tray in the direction orthogonal to the conveyance directions so that the sheets are moved to the processing tray in order to carry out the post processing in accordance with the post processing instruction.

* * * * *